US010739699B1

(12) United States Patent
Kato et al.

(10) Patent No.: US 10,739,699 B1
(45) Date of Patent: Aug. 11, 2020

(54) DEVELOPING DEVICE HAVING A DELIVERY UNIT TO TRANSPORT COLLECTED DEVELOPER AND IMAGE FORMING APPARATUS HAVING THE SAME

(71) Applicant: FUJI XEROX CO., LTD., Tokyo (JP)

(72) Inventors: Masanori Kato, Kanagawa (JP); Shinichi Kuramoto, Kanagawa (JP); Yoshifumi Ozaki, Kanagawa (JP); Tomoyuki Yoshii, Kanagawa (JP); Yoshitaka Nakajima, Kanagawa (JP); Norihiro Tamazawa, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/533,107

(22) Filed: Aug. 6, 2019

(30) Foreign Application Priority Data

Mar. 15, 2019 (JP) ..... 2019-048593

(51) Int. Cl.
*G03G 15/08* (2006.01)

(52) U.S. Cl.
CPC ..... *G03G 15/0815* (2013.01); *G03G 15/0891* (2013.01); *G03G 15/0893* (2013.01); *G03G 2215/0811* (2013.01); *G03G 2215/0838* (2013.01); *G03G 2215/0844* (2013.01)

(58) Field of Classification Search
CPC ..... G03G 15/0815; G03G 15/0891; G03G 15/0893; G03G 2215/0811; G03G 2215/0819; G03G 2215/0838; G03G 2215/0844
USPC ..... 399/254, 256
See application file for complete search history.

(56) References Cited

U.S. PATENT DOCUMENTS 8,326,189 B2 * 12/2012 Fukuda ..... G03G 15/0806 399/254
2008/0205938 A1 * 8/2008 Hirose ..... G03G 9/0806 399/254
2009/0103943 A1 * 4/2009 Sakata ..... G03G 15/09 399/111
2014/0086638 A1 * 3/2014 Sato ..... G03G 15/0891 399/252
2014/0112687 A1 * 4/2014 Ohmura ..... G03G 15/0893 399/254

(Continued)

FOREIGN PATENT DOCUMENTS

JP 2002072642 A * 3/2002
JP 2006-301449 A 11/2006
JP 2001-290369 A 10/2019

*Primary Examiner* — Robert B Beatty
(74) *Attorney, Agent, or Firm* — Sughrue Mion, PLLC

(57) ABSTRACT

A developing device includes a developer carrier that carries a developer to be supplied to an image carrier that forms an electrostatic latent image, a supply unit that supplies the developer containing toner and a carrier to the developer carrier by transporting the developer while agitating the developer along a circulation path formed through rotation of each of plural rotary members, and a delivery unit that receives a collected developer, which is the developer collected from the developer carrier, transports the collected developer by another rotary member different from the plural rotary members of the supply unit, and delivers the collected developer to the circulation path of the supply unit.

12 Claims, 4 Drawing Sheets

(56) References Cited

U.S. PATENT DOCUMENTS

| | | | | |
|---|---|---|---|---|
| 2015/0125185 | A1* | 5/2015 | Furukawa | G03G 15/0893 399/254 |
| 2018/0217521 | A1* | 8/2018 | Furuta | G03G 15/0893 |

* cited by examiner

DEVELOPING DEVICE HAVING A DELIVERY UNIT TO TRANSPORT COLLECTED DEVELOPER AND IMAGE FORMING APPARATUS HAVING THE SAME

CROSS-REFERENCE TO RELATED APPLICATIONS

This application is based on and claims priority under 35 USC 119 from Japanese Patent Application No. 2019-048593 filed Mar. 15, 2019.

BACKGROUND

(i) Technical Field

The present disclosure relates to a developing device and an image forming apparatus.

(ii) Related Art

For example, Japanese Unexamined Patent Application Publication No. 2006-301449 discloses a structure in which a developer separated from the surface of a developing sleeve after development is collected into a collection part, the collected developer is replenished with toner, and the developer replenished with toner is supplied to a developing part.

SUMMARY

Aspects of non-limiting embodiments of the present disclosure relate to the following circumstances. When a developer collected from a developer carrier is charged by agitating the developer and is supplied to the developer carrier, it is desirable to secure a longer agitation distance or a longer agitation time than in a case in which the collected developer is delivered to a circulation path of a supply unit that supplies the developer to the developer carrier.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device comprising a developer carrier that carries a developer to be supplied to an image carrier that forms an electrostatic latent image, a supply unit that supplies the developer containing toner and a carrier to the developer carrier by transporting the developer while agitating the developer along a circulation path formed through rotation of each of a plurality of rotary members, and a delivery unit that receives a collected developer, which is the developer collected from the developer carrier, transports the collected developer by another rotary member different from the plurality of rotary members of the supply unit, and delivers the collected developer to the circulation path of the supply unit.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure is described below in detail with reference to the accompanying drawings.

Figure 1:
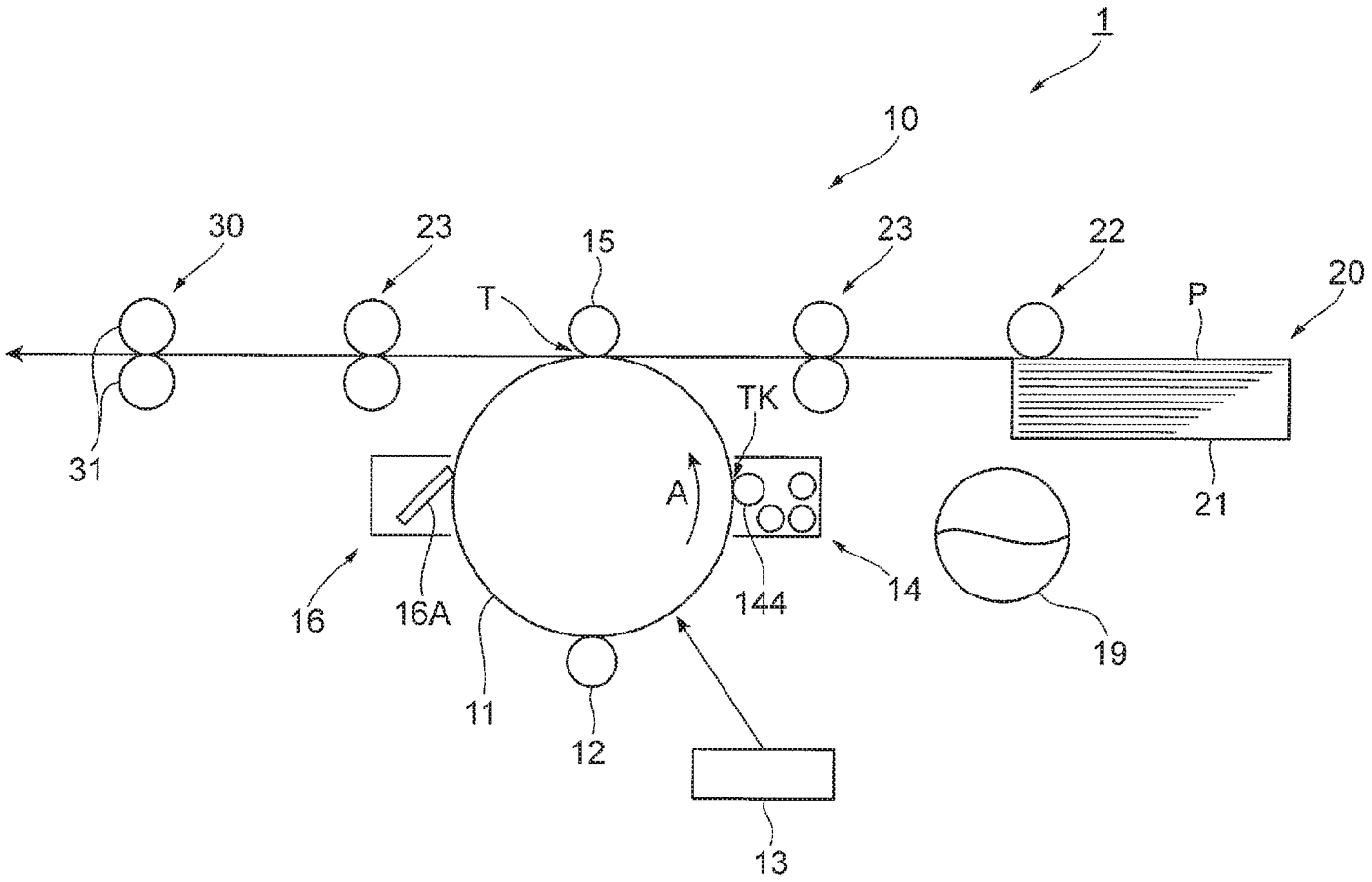
FIG. 1 illustrates the overall structure of an image forming apparatus.

FIG. 1 illustrates the overall structure of an image forming apparatus 1. To give an additional remark, FIG. 1 illustrates the image forming apparatus 1 that is viewed from a front side of the image forming apparatus 1.

The image forming apparatus 1 includes an image forming part 10, a paper feeding part 20, and a fixing part 30.

The image forming part 10 forms a toner image on paper P that is an example of a recording material by using an electrophotographic system. The paper feeding part 20 feeds the paper P to the image forming part 10. The fixing part 30 fixes, onto the paper P, an image that is the toner image formed on the paper P by the image forming part 10.

The image forming part 10 includes a photoconductor drum 11 that rotates in a direction indicated by an arrow A. Further, the image forming part 10 includes a charging roller 12, an exposing device 13, a developing device 14, a transfer roller 15, and a cleaning device 16.

The photoconductor drum 11 that is an example of an image carrier is constructed of a cylinder. A photosensitive layer (not illustrated) is formed on the surface of the cylinder.

The charging roller 12 is a conductive rubber roller or the like and charges the photoconductor drum 11.

The exposing device 13 radiates light from a light source such as a laser light source or a light emitting diode (LED) onto the photoconductor drum 11 charged by the charging roller 12 to form an electrostatic latent image on the surface of the photoconductor drum 11.

The developing device 14 that is an example of a developing unit causes toner to adhere to the surface of the photoconductor drum 11 to develop the electrostatic latent image formed on the photoconductor drum 11 with toner of a predetermined color. In this exemplary embodiment, the toner image is thus formed on the surface of the photoconductor drum 11.

The developing device 14 contains a developer. The developer of this exemplary embodiment is a so-called two-component developer constituted by a magnetic carrier and colored toner.

This exemplary embodiment provides a developer container 19 that contains the developer to be supplied to the developing device 14. In this exemplary embodiment, a new developer is supplied from the developer container 19 to the developing device 14 through a developer transport path (not illustrated).

The transfer roller 15 that is an example of a transfer unit is a conductive rubber roller or the like.

In this exemplary embodiment, a transfer part T is a part where the transfer roller 15 and the photoconductor drum 11 face each other. The toner image on the surface of the photoconductor drum 11, that is, the toner image carried by the photoconductor drum 11 is transferred onto the transported paper P at the transfer part T.

The cleaning device 16 includes a contact member 16A arranged in contact with the photoconductor drum 11. The cleaning device 16 removes adherents such as toner on the photoconductor drum 11.

In this exemplary embodiment, the transfer roller 15 transfers the toner image onto the paper P but the transfer method is not limited thereto. The transfer roller 15 may transfer the toner image onto an intermediate transfer belt (not illustrated).

The paper feeding part 20 includes a paper container 21 that contains the paper P, and a sending mechanism 22 that sends out the paper P from the paper container 21.

This exemplary embodiment provides paper transport mechanisms 23 that transport the paper P sent out from the paper feeding part 20 so that the paper P passes through the transfer part T and the fixing part 30.

The fixing part 30 that is an example of a fixing unit includes a pair of rotators 31 that rotate in contact with each other.

One of the pair of rotators 31 includes a heat source (not illustrated).

The fixing part 30 fixes, onto the paper P, the toner image on the paper P by pressurizing and heating the paper P with the two rotators 31.

An image forming operation of the image forming apparatus 1 is described.

In the image forming part 10, the photoconductor drum 11 that rotates in the direction indicated by the arrow A is charged by the charging roller 12. Next, the exposing device 13 exposes the surface of the photoconductor drum 11 to light to form an electrostatic latent image corresponding to image information on the surface of the photoconductor drum 11.

Then, the developing device 14 develops the electrostatic latent image to form a toner image corresponding to the electrostatic latent image on the surface of the photoconductor drum 11.

The toner image formed on the photoconductor drum 11 moves to the transfer part T along with the rotation of the photoconductor drum 11. The paper P sent out from the paper feeding part 20 is transported to the transfer part T by the paper transport mechanism 23.

The toner image on the photoconductor drum 11 is transferred onto the transported paper P at the transfer part T. Then, the paper P having the toner image transferred thereto is heated and pressurized through the fixing part 30 and the toner image is fixed onto the paper P.

Figure 2:
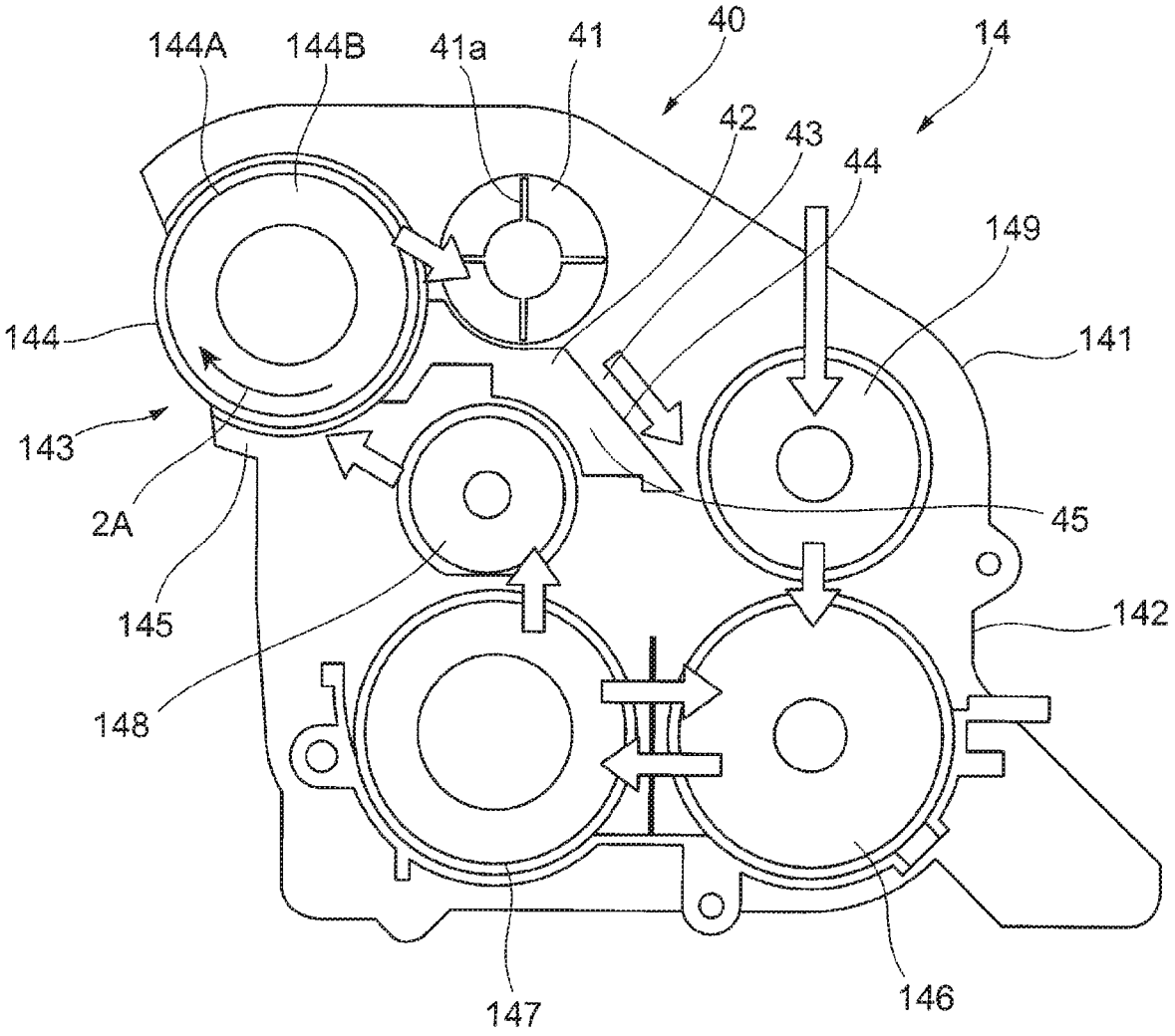
FIG. 2 illustrates a developing device.

FIG. 2 illustrates the developing device 14.

The developing device 14 includes a containing part 141 that contains the developer (not illustrated). The containing part 141 is constructed of a containing case 142 made of a resin.

The containing case 142 of the developing device 14 extends in a direction from the front side to a rear side of the image forming apparatus 1 (see FIG. 1), that is, in a direction orthogonal to the drawing sheet of FIG. 2. The containing case 142 has a far-side end (not illustrated) on the rear side and a near-side end (not illustrated) on the front side.

The containing case 142 that is an example of a supply unit has an opening 143 at a part that faces the photoconductor drum 11 (see FIG. 1). A developing roller 144 that causes the developer to adhere to the surface of the photoconductor drum 11 is provided at the opening 143.

The developing roller 144 that is an example of a developer carrier is formed into a columnar shape and extends in the direction from the front side to the rear side of the image forming apparatus 1. To give an additional remark, the developing roller 144 is arranged in a longitudinal direction of the developing device 14.

The developing roller 144 includes a developing sleeve 144A constructed of a cylinder and to be driven to rotate, and a magnet roller 144B arranged on an inner side of the developing sleeve 144A.

The developing sleeve 144A is made of a metal such as SUS. The developing sleeve 144A rotates in a direction indicated by an arrow 2A in FIG. 2.

In this exemplary embodiment, the developing sleeve 144A and the photoconductor drum 11 rotate so that the developing sleeve 144A and the photoconductor drum 11 move in the same direction at a facing part TK (see FIG. 1) between the developing roller 144 and the photoconductor drum 11.

The developing device 14 includes a layer regulating member 145 that regulates the layer thickness of the developer carried by the developing roller 144.

As illustrated in FIG. 2, the developing device 14 includes a first transport member 146 and a second transport member 147 that transport the developer.

The first transport member 146 and the second transport member 147 that are examples of a plurality of rotary members are provided opposite the position where the photoconductor drum 11 (see FIG. 1) is arranged across the developing roller 144.

The first transport member 146 has a rotation shaft along a rotation shaft of the developing sleeve 144A that is driven to rotate. The first transport member 146 rotates about the rotation shaft to transport the developer in the containing part 141.

Figure 3:
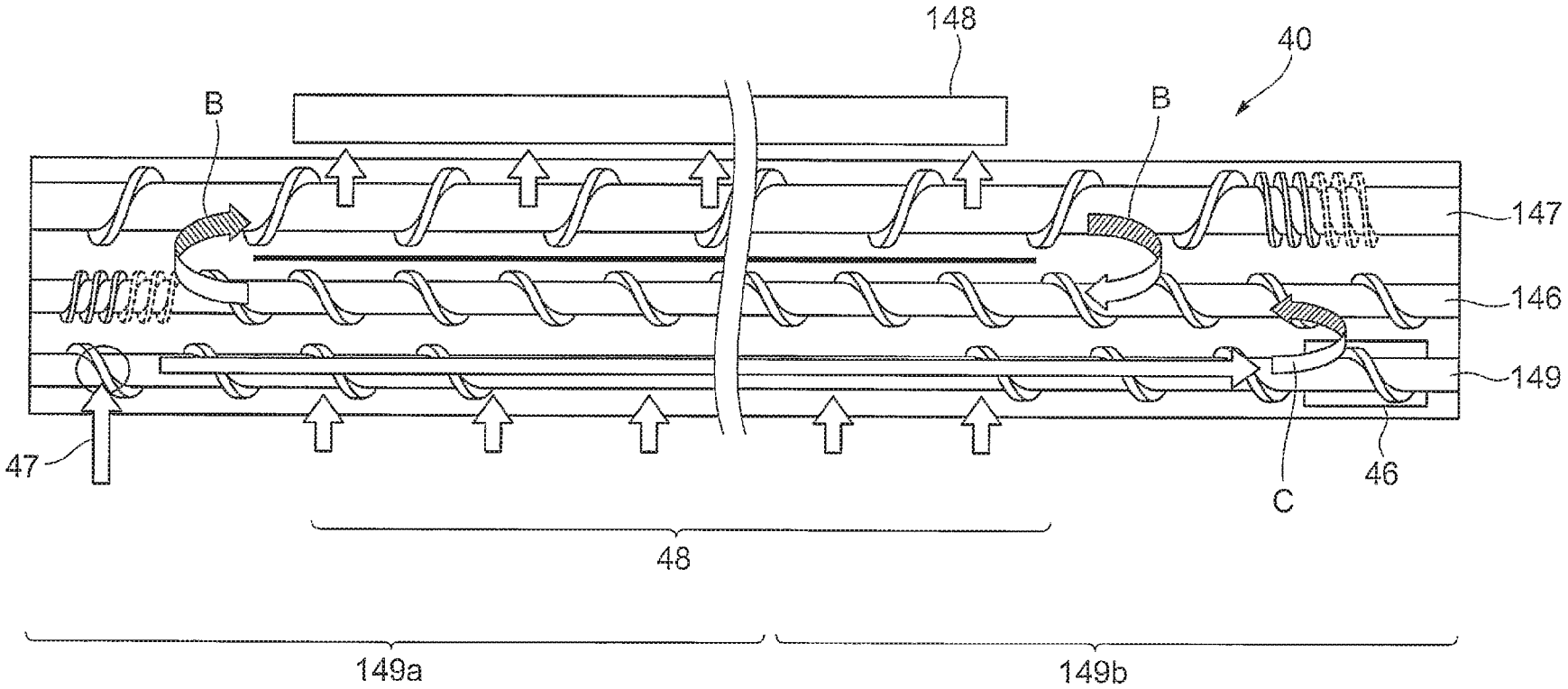
FIG. 3 is a plan view illustrating a first transport member, a second transport member, a third transport member, and a fourth transport member of the developing device.

A partition wall indicated by a thick straight line is formed between the first transport member 146 and the second transport member 147 (see FIG. 2 or FIG. 3).

In the developing device 14 constructed as described above, new toner or toner having a trace of carrier added thereto (hereinafter referred to as added toner) is supplied from the developer container 19. The toner circulates between the first transport member 146 and the second transport member 147 while being agitated. More specifically, the developer is exchanged through communication ports formed at both ends of the partition wall extending in an axial direction. Thus, the developer agitated by the first transport member 146 may be agitated by the second transport member 147 and may further be agitated by the first transport member 146. The developing device 14 has a circulation path along which the developer circulates in the axial direction through rotation of the first transport member 146 and the second transport member 147.

As illustrated in FIG. 2, the developing device 14 includes a third transport member 148 between the developing roller 144 and the second transport member 147. The third transport member 148 delivers, to the developing roller 144, the developer that is transported while being agitated.

The developing device 14 includes a fourth transport member 149 located above the first transport member 146. The fourth transport member 149 is an example of a delivery unit or another rotary member.

A transport path formed through rotation of the fourth transport member 149 is connected to the circulation path. The fourth transport member 149 receives a collected developer, which is a developer collected from the developing roller 144, and the added toner from the developer container 19, transports the collected developer and the added toner along the transport path while agitating the collected developer and the added toner, and delivers the collected developer and the added toner to the first transport member 146 on the circulation path.

In this exemplary embodiment, the collected developer is transported in the axial direction while being agitated together with the new developer by the fourth transport member 149. The collected developer is also transported while being agitated by the first transport member 146 and the second transport member 147.

The developing roller 144, the layer regulating member 145, the first transport member 146, the second transport member 147, the third transport member 148, and the fourth transport member 149 are arranged substantially parallel to the photoconductor drum 11 (see FIG. 1).

The supply unit herein includes at least the containing case 142 and the first transport member 146, the second transport member 147, and the third transport member 148 described later that are contained in the containing case 142.

Next, description is made of a collected developer transport part 40 that transports the collected developer from the developing roller 144 to the fourth transport member 149 in the developing device 14. The collected developer transport part 40 is an example of a movement part.

As illustrated in FIG. 2, a paddle member 41 that rotates in one direction under a drive force between the developing roller 144 and the fourth transport member 149 is provided on an upstream side of the collected developer transport part 40. The paddle member 41 is rotated by the drive force to move the collected developer. The paddle member 41 has a plurality of plate-shaped members 41*a* extending in a radial direction from a rotation shaft when the paddle member 41 is viewed in a direction in which the rotation shaft extends.

A curved surface 42 is provided below the paddle member 41. The curved surface 42 is formed into a downwardly recessed shape so that the distance from the paddle member 41 is reduced without hindering the rotation of the paddle member 41. The curved surface 42 is a place for the collected developer. With the curved surface 42, the collected developer is delivered from the developing roller 144 to the fourth transport member 149 without stagnation. The curved surface 42 is a transport surface along which the collected developer is transported. The collected developer coagulated on the curved surface 42 is crumbled through the rotation of the paddle member 41 above the curved surface 42.

The paddle member 41 and the curved surface 42 are examples of a second movement part. The paddle member 41 is an example of a driving movement part and the curved surface 42 is an example of a second surface.

As illustrated in FIG. 2, a transport surface 43 is provided on a downstream side of the collected developer transport part 40. With the transport surface 43, the collected developer is transported to the fourth transport member 149 without a drive force. The collected developer is moved along the transport surface 43 without involving rotation under a drive force. The transport surface 43 of this exemplary embodiment includes an inclined surface 44 along which the collected developer falls owing to inclination. The inclined surface 44 is inclined substantially straight so that the paddle member 41 side is high and the fourth transport member 149 side is low. The collected developer rolls down the inclined surface 44 by an action of self-weight to move toward the fourth transport member 149.

In this exemplary embodiment, the curved surface 42 and the inclined surface 44 are formed by a single member 45 but may be formed by separate members.

The transport surface 43 and the inclined surface 44 are examples of a first movement part and the inclined surface 44 is an example of a first surface.

In this exemplary embodiment, the collected developer transport part 40 includes the paddle member 41 and the curved surface 42 that move the collected developer through rotation, and the transport surface 43 and the inclined surface 44 that move the collected developer by the self-weight. The collected developer transport part 40 moves the collected developer by different methods. By achieving the movement of the collected developer by the plurality of different methods, the collected developer is smoothly moved depending on, for example, the internal structure of the developing device 14.

The term "different methods" herein means that actions of the collected developer transport part 40 for achieving the movement of the collected developer are different from each other. The situation in which the actions are different from each other includes a case in which a drive force of a drive source is used and a case in which the drive force is not used. For example, the former is a case in which a rotational force is used and the latter is a case in which gravity is used.

For example, the situation in which the actions are different from each other also includes a case in which a movable body that is movable by the drive force of the drive source moves the collected developer through rotation and a case in which the movable body moves the collected developer through sliding.

The "different methods" do not apply to a case in which the actions are completely the same but apply to a case in which the actions partially overlap each other and one of the actions is partially different from the other. Examples of this case include a case in which one of the actions is caused by rotation and gravity and the other is caused by gravity alone, and a case in which one of the actions is caused by sliding and gravity and the other is caused by gravity alone.

The curved surface 42 is a place for the collected developer and the collected developer is more difficult to fall along the curved surface 42 than along the inclined surface 44. Therefore, the transport of the collected developer may be hindered by coagulation of the collected developer. This exemplary embodiment provides the paddle member 41 that rotates above the curved surface 42 and a lump of the collected developer on the curved surface 42 is crumbled through the rotation of the paddle member 41 and moved to the downstream side. Therefore, the collected developer is smoothly delivered to the fourth transport member 149.

The second surface that is the curved surface 42 as an example and the first surface that is the inclined surface 44 as an example are different from each other in terms of easiness of falling of the collected developer and are provided with their inclination angles and shapes different from each other. The collected developer does not actively move to the downstream side along the curved surface 42 compared with the inclined surface 44. The collected developer is rather difficult to move to the downstream side along the curved surface 42. The curved surface 42 has the downwardly recessed shape so that the paddle member 41 easily applies an external force to the collected developer. The inclined surface 44 is inclined toward the downstream side so that the collected developer sent out by the paddle member 41 easily falls by the self-weight without reducing the sending force. The surface roughnesses or the coefficients of friction of the curved surface 42 and the inclined surface 44 may be varied so that the curved surface 42 and the inclined surface 44 have the difference in terms of the easiness of falling of the collected developer.

The paddle member 41 is rotated by the drive force so that the plurality of plate-shaped members 41*a* crumble the lump of the collected developer and transport the crumbled collected developer toward the fourth transport member 149. In this exemplary embodiment, the number of plate-shaped members 41*a* is four but is not limited thereto.

FIG. 3 is a plan view illustrating the first transport member 146, the second transport member 147, the third transport member 148, and the fourth transport member 149 of the developing device 14. To give an additional remark, the left side of FIG. 3 is the front side of the image forming apparatus 1 and the right side of FIG. 3 is the rear side of the image forming apparatus 1.

As illustrated in FIG. 3, the circulation path is formed so that the developer is transported while being agitated through the rotation of the first transport member 146 and the second transport member 147 (see arrows B). The developer in the circulation path is transported from the second transport member 147 to the developing roller 144 via the third transport member 148.

The transport path is formed so that the developer is transported while being agitated through the rotation of the fourth transport member 149. An opening 46 is formed on a downstream side of the transport path. The transport path is connected to the first transport member 146 side of the circulation path via the opening 46 (see an arrow C).

The collected developer is returned to the fourth transport member 149 at the end of an upstream side out of the second transport member 147, the third transport member 148, and the fourth transport member 149.

The fourth transport member 149 at the end of the upstream side is replenished with a new developer from the developer container 19 and the collected developer transported by the collected developer transport part 40 is returned to the fourth transport member 149.

Assuming that the fourth transport member 149 is divided into an upstream part 149*a* and a downstream part 149*b* in a rotation axis direction, the fourth transport member 149 is replenished with the new developer at a position indicated by an arrow 47, that is, at the upstream part 149*a*. The collected developer is transported at a position of a region 48 extending in the transport direction, that is, transported into the upstream part 149*a* and into the downstream part 149*b* as well. A major part of the region 48 is present in the upstream part 149*a*.

The position indicated by the arrow 47 is a position on the upstream side in the transport direction with respect to the region 48. At the position indicated by the arrow 47, blocking is likely to occur in the added toner supplied from an upper side in the gravity direction. In the region 48, the blocking is resolved such that the added toner impinges on the collected developer having a relatively low toner density in the developing device 14.

Figure 4:
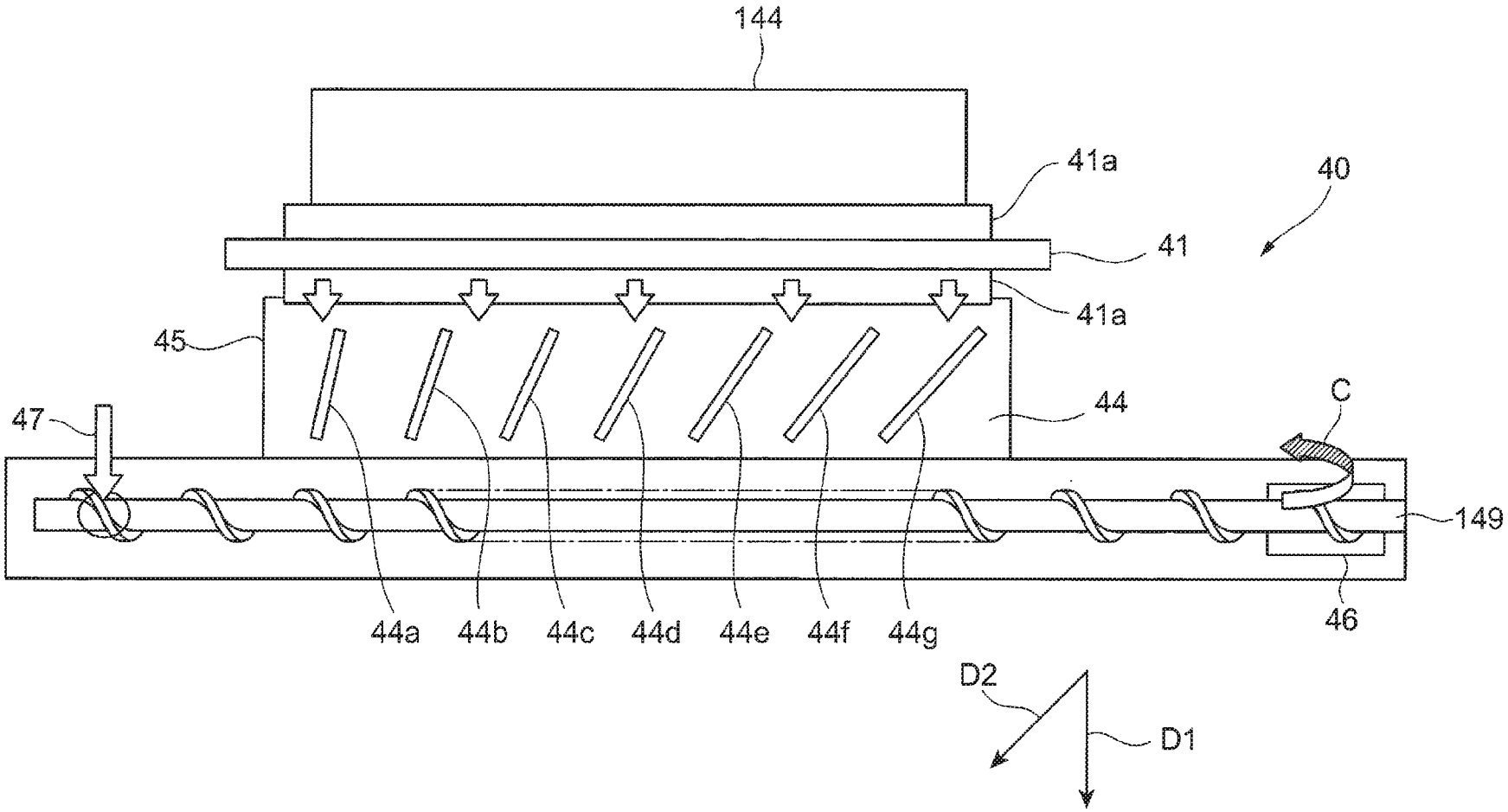
FIG. 4 is a plan view illustrating a developing roller, a collected developer transport part, and the fourth transport member of the developing device.

FIG. 4 is a plan view illustrating the developing roller 144, the collected developer transport part 40, and the fourth transport member 149 of the developing device 14. To give an additional remark, the left side of FIG. 4 is the front side of the image forming apparatus 1 and the right side of FIG. 4 is the rear side of the image forming apparatus 1.

As illustrated in FIG. 4, a plurality of ribs 44*a*, 44*b*, 44*c*, 44*d*, 44*e*, 44*f*, and 44*g* are formed on the inclined surface 44 of the collected developer transport part 40. The ribs 44*a* to 44*g* are used for directing the collected developer.

In this exemplary embodiment, particles of the collected developer are sequentially transported in the transport direction of the fourth transport member 149 instead of being collectively transported into the fourth transport member 149.

A direction in which the distance between the inclined surface 44 and the fourth transport member 149 is shortest is defined as a reference direction D1 and a direction intersecting the reference direction D1 is defined as an intersecting direction D2.

In this exemplary embodiment, the plurality of ribs 44*a* to 44*g* that are examples of a directing part extend in the intersecting direction D2 instead of the reference direction D1. More specifically, the intersecting direction D2 of each of the plurality of ribs 44*a* to 44*g* intersects the reference direction D1 so that the ribs 44*a* to 44*g* are oriented to the upstream side in the transport direction of the fourth transport member 149 (left side of FIG. 4) with increasing proximity to the fourth transport member 149.

In this exemplary embodiment, the intersecting directions D2 of the ribs 44*a* to 44*g* are different from each other. That is, assuming that an angle at which the intersecting direction D2 of each of the ribs 44*a* to 44*g* intersects the reference direction D1 is an intersecting angle, the intersecting angles of the ribs 44*a* to 44*g* are different from each other.

The intersecting angle on the downstream side in the transport direction of the fourth transport member 149 (right side of FIG. 4) is larger than the intersecting angle on the upstream side in the transport direction (left side of FIG. 4). In this exemplary embodiment, the intersecting angles of the plurality of ribs 44*a* to 44*g* are larger toward the downstream side in the transport direction. The intersecting angle of the rib 44*a* is smallest and the intersecting angle of the rib 44*g* is largest. The intersecting angles are set so that the collected developer is transported into the fourth transport member 149 at a position closer to the end of the upstream side in the transport direction.

The transport distances of the collected developer along the plurality of ribs 44*a* to 44*g* on the inclined surface 44 are longer toward the downstream side in the transport direction.

In this exemplary embodiment, the third transport member 148 that transports the developer to the developing roller 144 is located below the developing roller 144 (see FIG. 2) but the location is not limited thereto. The third transport member 148 may be located above the developing roller 144.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device, comprising:

a developer carrier that carries a developer to be supplied to an image carrier that forms an electrostatic latent image;

a supply unit that supplies the developer containing toner and a carrier to the developer carrier by transporting the developer while agitating the developer along a circulation path formed through rotation of each of a plurality of rotary members;

a delivery unit that receives a collected developer, which is the developer collected from the developer carrier, transports the collected developer by another rotary member different from the plurality of rotary members of the supply unit, and delivers the collected developer to the circulation path of the supply unit; and a toner replenishment portion where new toner is added to the developing device, wherein the other rotary member is configured to transport the collected developer along an axial direction of a rotational axis of the other rotary member, and the toner replenishment portion is configured to supply new toner to the to one side on the axial direction of the other rotary member.

2. The developing device according to claim 1, wherein the transport path formed along the axial direction of the rotational axis of the other rotary member of the delivery unit is divided into an upstream part and a downstream part in a transport direction parallel to the axial direction, the collected developer is received within both the upstream part and the downstream part.

3. The developing device according to claim 2, wherein the collected developer is transported into the upstream part and the downstream part from a region extends along the transport direction of the other rotary member, and wherein a center part of the region is positioned adjacent the upstream part.

4. The developing device according to claim 3, wherein the developing device is replenished with the toner on an upstream side in the transport direction with respect to the region.

5. The developing device according to claim 1, further comprising a movement part that is located between the developer carrier and the delivery unit and moves the collected developer to the delivery unit, wherein the movement part comprises a first movement part and a second movement part that move the collected developer by different methods.

6. The developing device according to claim 5, wherein the first movement part comprises a first surface along which the collected developer falls owing to inclination, wherein the second movement part is located closer to the developer carrier than the first movement part is located, and wherein the second movement part comprises:

a second surface along which the collected developer is more difficult to fall than to fall along the first surface; and a driving movement part that moves the collected developer on the second surface toward the first movement part by a drive force.

7. The developing device according to claim 6, wherein the first movement part comprises a directing part that directs the collected developer to an upstream side in a transport direction.

8. An image forming apparatus, comprising:

an image carrier that forms an electrostatic latent image;

a developing unit that develops the electrostatic latent image formed by the image carrier into a toner image;

a transfer unit that transfers the toner image formed by the developing unit onto a recording material; and a fixing unit that fixes, onto the recording material, the toner image transferred onto the recording material, wherein the developing unit comprises:

a developer carrier that carries a developer to be supplied to the image carrier;

a supply unit that supplies the developer containing toner and a carrier to the developer carrier by transporting the developer while agitating the developer along a circulation path formed through rotation of each of a plurality of rotary members; and a delivery unit that receives a collected developer, which is the developer collected from the developer carrier, transports the collected developer by another rotary member different from the plurality of rotary members of the supply unit, and delivers the collected developer to the circulation path of the supply unit; and a toner replenishment portion where new toner is added to the developing device, wherein the other rotary member is configured to transport the collected developer along an axial direction of a rotational axis of the other rotary member, and the toner replenishment portion is configured to supply new toner to the to one side on the axial direction of the other rotary member.

9. A developing device, comprising:

a developer carrier that carries a developer to be supplied to an image carrier that forms an electrostatic latent image;

supply means for supplying the developer containing toner and a carrier to the developer carrier by transporting the developer while agitating the developer along a circulation path formed through rotation of each of a plurality of rotary members; and delivery means for receiving a collected developer, which is the developer collected from the developer carrier, transporting the collected developer by another rotary member different from the plurality of rotary members of the supply means, and delivering the collected developer to the circulation path of the supply means; and a toner replenishment portion where new toner is added to the developing device, wherein the other rotary member is configured to transport the collected developer along an axial direction of a rotational axis of the other rotary member, and the toner replenishment portion is configured to supply new toner to the to one side on the axial direction of the other rotary member.

10. The developing device according to claim 1, wherein the plurality of rotary members and the other rotary member are augers configured to transport the developer along an axial direction of rotation, and the other rotary member supplies the collected developer directly to one of the plurality of rotary members.

11. The image forming apparatus according to claim 8, wherein the plurality of rotary members and the other rotary member are augers configured to transport the developer along an axial direction of rotation, and the other rotary member supplies the collected developer directly to one of the plurality of rotary members.

12. The developing device according to claim 9, wherein the plurality of rotary members and the other rotary member are augers configured to transport the developer along an axial direction of rotation, and the other rotary member supplies the collected developer directly to one of the plurality of rotary members.

* * * * *